United States Patent [19]

Voss et al.

[11] Patent Number: 4,923,575

[45] Date of Patent: May 8, 1990

[54] AQUEOUS ALKALINE BATH AND PROCESS FOR ELECTRODEPOSITION OF A ZINC-IRON ALLOY

[75] Inventors: Günter Voss; Martin Kurpjoweit; Wolfgang Richter, all of Berlin, Fed. Rep. of Germany

[73] Assignee: Schering Aktiengesellschaft, Berlin and Bergkamen, Fed. Rep. of Germany

[21] Appl. No.: 364,610

[22] Filed: Jun. 9, 1989

[30] Foreign Application Priority Data

Jun. 9, 1988 [DE] Fed. Rep. of Germany ..... 3819892

[51] Int. Cl.[5] ..... C25D 3/56

[52] U.S. Cl. ..... 204/44.2

[58] Field of Search ..... 204/44.2, 44.5; 420/513

[56] References Cited

U.S. PATENT DOCUMENTS 306,227 10/1984 Dick ..... 420/513
4,581,110 4/1986 Tsuchida et al. ..... 204/44.2
4,717,458 1/1988 Martin et al. ..... 204/44.2
4,772,362 9/1988 Martin et al. ..... 204/44.2

FOREIGN PATENT DOCUMENTS 192240 11/1982 Japan .

OTHER PUBLICATIONS

Ray Q. Brewster, "Organic Chemistry", pp. 430–465, (1948).
Hackh's Chemical Dictionary, p. 592, Fourth Edition, (1969).

*Primary Examiner*—G. L. Kaplan
*Attorney, Agent, or Firm*—Michael J. Striker

[57] ABSTRACT

The aqueous alkaline bath for electrochemical deposition of a zinc-iron alloy according to our invention contains a zincate and a compound of iron with a sugar. Advantageously sugar including monosaccharides, trisaccharides and disaccharides such as sucrose are used to form this iron compound. The iron compound may be an iron saccharate. An alloy with superior corrosion resistance is the product of an electrochemical deposition using this bath.

15 Claims, No Drawings

AQUEOUS ALKALINE BATH AND PROCESS FOR ELECTRODEPOSITION OF A ZINC-IRON ALLOY

BACKGROUND OF THE INVENTION

Our invention relates to a process for making a zinc-iron alloy, to an improved aqueous alkaline bath for electrochemical deposition of the zinc-iron alloy and to the zinc-iron alloy made thereby.

An electrochemical deposition of a zinc-iron alloy from an aqueous alkaline bath containing as essential components a zincate and an iron compound is known.

An electrolyte for deposition of a zinc-iron alloy has been known for a long time. Its technical usage has been limited above all to strip or band galvanizing not just because of its very highly-current density dependent alloy composition.

Recently acid baths have been introduced on the market from which a corrosion resistant alloy of zinc with nickel, cobalt, iron or chromium can be deposited. Despite relatively good to very good corrosion data the application spectrum of such electrolytes remains remarkably narrow. The reason for that is the instabilities of the electrolyte, because of the high salt concentration and the problematical alloy composition which is current density dependent. The same is true for the zinc baths which are currently known, which have the disadvantage that the zinc-iron alloy prepared from them can not be usable as an outer or end surface since the iron component forms both white or red rust very quickly.

The reason for the unsatisfactory corrosion properties of the current zinc-iron coating may be that they were deposited from baths which hold different however totally unsatisfactory chelating agents. Some of these chelating agents including hydroxy carbonic acids, amino alcohols, polyamines, amino carbonic acids and others where named in German Patent No. 3 506 709

Furthermore iron salts are used in these baths which leads to an enrichment of undesirable foreign ions.

SUMMARY OF THE INVENTION

Accordingly, it is an object of our invention to provide a bath of the above-described kind which allows a deposition of a highly corrosion resistant zinc-iron alloy independently of the current density while avoiding troublesome foreign ions.

In keeping with this object and with others which will become apparent hereinafter, the bath contains an iron compound of iron with a sugar. By "sugar" we mean in this present application any saccharide including a monosaccharide, a disaccharide and/or a trisaccharide.

Advantageously this sugar can be a monosaccharide, a disaccharide or a trisaccharide. The iron compound can also be an iron saccharide. The zinc is advantageously present as sodium zincate.

The zinc is advantageously contained in the electrochemical bath with a zinc concentration of from 1 to 40 g/liter, advantageously 4 to 12 g/l. Alkali hydroxide is present in a concentration of 60 to 200 g/liter, advantageously 80 to 140 g/liter. Iron is present in a concentration of from 0.001 to 10 g/liter, advantageously 0.05 to 4 g/liter. Sucrose is present advantageously in a concentration of from 1 to 100 g/liter, advantageously 30 to 60 grams/liter. The aqueous alkaline bath advantageously contains a polishing agent and a glazing agent also.

Also in keeping with these objects a process for electrochemical deposition of a zinc-iron alloy is characterized by an aqueous alkaline bath as described above, including a zincate and an iron compound, present as a monosaccharide, a disaccharide or a trisaccharide.

This process is advantageously performed at a temperature of from about 0° to 60° C. and with a current density of from 0.10 to 10 A/dm$^2$. This process produces a zinc-iron alloy with an iron content of from 0.05 to 20 %. This zinc-iron alloy is also part of our invention.

The bath according our invention allows in an outstanding way the deposition of a nearly constant composition zinc-iron alloy coating with an extraordinarily high corrosion resistance.

The current density-independence is particularly surprising and of greater technical significance for the process performance.

The absence of troublesome foreign ions and additional complexing and/or chelating agents is particularly advantageous.

It is particularly advantageous when sodium zincate is used, however as desired other alkali zincates can be used.

In addition to alkali hydroxides also mixtures of alkali hydroxides with alkali carbonates can be used in the bath.

As binding agents for iron sugars such as monosaccharides, disaccharides, trisaccharides and starch decomposition products can be used.

The iron saccharate to be used according to our invention is known and can be made by a process which is known for example by converting iron-II-chloride, soda, sucrose and solution of caustic soda.

It is particularly advantageous to use sugar and/or saccharides in the bath in excess.

EXAMPLES

The use of the bath according to our invention occurs in a known way with the following process conditions:

Temperature : 25° C.

Current density: 1 to 4 A/dm$^2$ pH value: $>13$

Iron-Steel is particularly suitable as a substrate for the zinc-iron alloy coating to be deposited.

The basic composition of the bath according to the invention is as follows:

| | |
|---|---|
| 120 g/liter | alkali hydroxide |
| 10 g/liter | zinc oxide |
| 30 g/liter | alkali carbonate |

The alloy coating deposited from the bath according to our invention can be provided in a known way by a suitable chromium solution with a chromate covering layer.

By a "saccharate" in this specification and the appended claims we mean the salt of a metal with a sugar, i.e. with a monosaccharide, disaccharide or trisaccharide. For example the compounds of the invention are by definition iron saccharates.

The following examples serve for illustration of the invention.

EXAMPLE I

The following tables show the iron alloy composition(iron component) with different current densities depending on the zinc and iron concentration of the bath.

TABLE I

| Bath (g/liter) | | % Iron in the Coating Current density (A/dm²) | | | |
|---|---|---|---|---|---|
| Zn | Fe | 1 | 2 | 3 | 4 |
| | | % Fe in coating | | | |
| 7.6 | 0.05 | 0.24 | 0.24 | 0.24 | 0.26 |
| 8.0 | 0.2 | 0.7 | 0.7 | 0.7 | 0.74 |
| 8.9 | 0.5 | 1.1 | 1.1 | 1.1 | 1.1 |

Besides the components listed in the Table I above the bath has the following composition:

120 g/liter NaOH
30 g/liter $Na_2CO_3$
10 g/liter Sodium Zincate
8 g/liter Glazing additive The results show the extraordinary properties of the bath according to our invention, namely a comparatively low iron concentration in the electrolytes with however an extraordinarily uniform iron content in the coating with different current densities.

For comparison the corresponding data for a typical commercial alkali Zinc-Iron bath is set forth in Table II below:

TABLE II

| Bath (g/liter) | | Current density (A/dm²) | | | |
|---|---|---|---|---|---|
| Zn | Fe | 1 | 2 | 3 | 4 |
| | | % Fe in coating | | | |
| 19 | 0.33 | 0.26 | 0.47 | 0.61 | — |

EXAMPLE 2

From a bath of the composition described in Example I in Table I an 8 micrometer thick Zinc-Iron coating was deposited. It contained 0.5 % Fe.

This coating was passivated by immersion in a standard chromat solution.

A portion of the sample was tempered(as required by the Auto industry) after chromate treatment 1 hour at 120° C., the residue was dried at 60° to 80° C. for about 15 minutes.

After a storage time of at least one week the sample was tested in a salt test according to DIN(German Industrial Standard) 50021 SS, (a) until a definite beginning of surface corrosion(-white rust);

(b) until at the occurrence of red rust.

Parallel samples made under optimum conditions from alkali zinc electrolytes for comparison are tested. The results are shown in the following Table III:

TABLE III

| Coating system | Corrosion in Salt Test. Tempering 120° C.x 1hr | Hours Salt Test to: White rust | Red rust |
|---|---|---|---|
| Zn-chromate | no | 360/420 | 720 |
| Zn-chromate | yes | 48/144 | — |
| Zn-Fe-chromate | no | >984/>984 | >1000 |
| Zn-Fe-chromate | yes | 504/528 | — |

With this comparison it must be noted that the chromated Zinc sample used for comparison already has extraordinarily good properties. However the Zn-Fe-chromate samples are more stable.

The corrosion resistance attained with the untempered sample shown in about 1000 hours of a salt test of Zn-Fe-chromate was similar to the corrosion resistance attainable currently only with a special Zinc-Nickel process from an acid bath, which has however the disadvantages apparent from Table IV indicated below:

TABLE IV

| Feature | Differences between Zn-Ni (acid) and Zn-Fe. (alkali on the basis of sugar) Zn—Fe | Zn—Ni |
|---|---|---|
| (a) Bath | Alkali<br>no waste water | Acid<br>high ammoniacal alkali (>200 g/l)<br>Waste water |
| (b) Anode | Insoluble iron anode<br>Zinc is chemically dissolved.<br>Inner anode for qualitative improvement possible | Separate Zn & Ni<br>Double current required.<br>Inner electrode problematical, because insoluble scarcely usable in hydrochloride-containing acid electrolyte |
| (c) Alloy | Optimum corrosion protection already at 0.3 to 1.0 % Fe | At least 10% Ni required in coating for optimum corrosion protection |
| (d) Other | Easy to maintain<br>Electrolyte with only reduced concentration in alloy metal (0.1–0.5 g/l Fe) current density-independent alloy composition | Complicated, nearly saturated bath, with high content in alloy metal (> 10 g/lNi).<br>Alloy composition is current density sensitive |

It will be understood that each of the elements described above, or two or more together, may also find a useful application in other types of constructions differing from the types described above.

While the invention has been illustrated and described as embodied in an aqueous alkaline bath for electrochemical deposition of a zinc-iron alloy, an alloy made thereby and a process for making that alloy, it is not intended to be limited to the details shown, since various modifications and structural changes may be made without departing in any way from the spirit of the present invention.

What is claimed as new and desired to be protected by Letters Patent is set forth in the appended claims.

1. In an aqueous alkaline bath for electrochemical deposition of a Zinc-Iron alloy containing a zincate. and an iron compound as essential constituents, the improvement wherein said iron compound comprises a compound of iron with a sugar.

2. The improvement according to claim 1 wherein said sugar is selected from the group consisting of monosaccharides, disaccharides and trisaccharides.

3. The improvement according to claim 1 wherein said iron compound comprises an iron saccharate.

4. The improvement according to claim 1 wherein said zincate comprises sodium zincate.

5. The improvement according to claim 1 wherein said aqueous alkaline bath has a zinc concentration of from 1 to 40 g/liter.

6. The improvement according to claim 5 wherein said zinc concentration is from 4 to 12 g/liter.

7. The improvement according to claim 1 wherein said bath further comprises an alkali hydroxide in a concentration of from 60 to 200 g/liter.

8. The improvement according to claim 7 wherein said concentration of said alkali hydroxide is from 80 to 140 g/liter.

9. The improvement according to claim 1 wherein said iron is present in a concentration of from 0.001 to 10 g/liter.

10. The improvement according to claim 9 wherein said concentration of said iron is from 0.05 to 4 g/liter.

11. The improvement according to claim 1 wherein said sugar comprises sucrose and said sucrose is in a concentration of from 1 to 100 g/liter.

12. The improvement according to claim 11 wherein said concentration of said sucrose is from 30 to 60 g/liter.

13. The improvement according to claim 1 wherein said bath further contains a glazing agent and a polishing agent.

14. An electrochemical deposition process for making a zinc-iron alloy in which said aqueous alkaline bath according to claim 1 is used.

15. An electrochemical deposition process according to claim 14 performed at a temperature of from 0 to 60° C. and a current density of from 0.1 to 10 $A/dm^2$.

* * * * *